US006818264B1

(12) United States Patent
Samperisi, Jr.

(10) Patent No.: US 6,818,264 B1
(45) Date of Patent: Nov. 16, 2004

(54) CORNER/WALL SITUATED CHRISTMAS TREE STAND

(76) Inventor: Joe Samperisi, Jr., 127 Wildwing Park Rd., Catskill, NY (US) 12414

( * ) Notice: Subject to any disclaimer, the term of this patent is extended or adjusted under 35 U.S.C. 154(b) by 60 days.

(21) Appl. No.: 10/392,792

(22) Filed: Mar. 21, 2003

(51) Int. Cl.[7] ..... A47G 33/06
(52) U.S. Cl. ..... 428/20; 428/18
(58) Field of Search ..... 428/36.9, 18, 20; 211/205, 196; 248/519, 536

(56) References Cited

U.S. PATENT DOCUMENTS 3,027,671 A 4/1962 Durall
3,278,364 A 10/1966 Dieffenbach
3,857,748 A 12/1974 Thomann
4,109,036 A 8/1978 Lloyd et al.
5,307,252 A 4/1994 Croup et al.
5,409,745 A * 4/1995 McGuire ..... 428/18
6,057,010 A 5/2000 Ayers

* cited by examiner

*Primary Examiner*—Alexander S. Thomas

(57) ABSTRACT

A corner/wall situated Christmas tree stand for enabling a user to set up a Christmas tree against a wall or in a corner in a confined living quarters. The corner/wall situated Christmas tree stand includes a base assembly including a tubular support base having a wall, an open top, and a bore being disposed therein through the open top, for resting in a corner or against a wall structure; and also includes an elongate tubular tree support member being removably supported upon the tubular support base and being adapted to support branches of an artificial Christmas tree for resting in a corner or against a wall structure.

6 Claims, 4 Drawing Sheets

CORNER/WALL SITUATED CHRISTMAS TREE STAND

BACKGROUND OF THE INVENTION

1. Field of the Invention

The present invention relates to Christmas tree stands and more particularly pertains to a new corner/wall situated Christmas tree stand for enabling a user to set up a Christmas tree against a wall or in a corner in a confined living quarters.

2. Description of the Prior Art

The use of Christmas tree stands is known in the prior art. More specifically, Christmas tree stands heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 6,057,010; U.S. Pat. No. 5,307,252; U.S. Pat. No. 4,109,036; U.S. Pat. No. 3,857,748; U.S. Pat. No. 3,027,671; and U.S. Pat. No. 3,278,364.

While these devices fulfill their respective, particular objectives and requirements, the aforementioned patents do not disclose a new corner/wall situated Christmas tree stand. The prior art includes conventional Christmas tree stands for supporting Christmas trees.

SUMMARY OF THE INVENTION

The general purpose of the present invention, which will be described subsequently in greater detail, is to provide a new corner/wall situated Christmas tree stand which has many of the advantages of the Christmas tree stands mentioned heretofore and many novel features that result in a new corner/wall situated Christmas tree stand which is not anticipated, rendered obvious, suggested, or even implied by any of the prior art Christmas tree stands, either alone or in any combination thereof. The present invention includes a base assembly including a tubular support base having a wall, an open top, and a bore being disposed therein through the open top, for resting in a corner or against a wall structure; and also includes an elongate tubular tree support member being removably supported upon the tubular support base and being adapted to support branches of an artificial Christmas tree for resting in a corner or against a wall structure. None of the prior art includes the combination of the elements of the present invention.

There has thus been outlined, rather broadly, the more important features of the corner/wall situated Christmas tree stand in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new corner/wall situated Christmas tree stand which has many of the advantages of the Christmas tree stands mentioned heretofore and many novel features that result in a new corner/wall situated Christmas tree stand which is not anticipated, rendered obvious, suggested, or even implied by any of the prior art Christmas tree stands, either alone or in any combination thereof.

Still another object of the present invention is to provide a new corner/wall situated Christmas tree stand for enabling a user to set up a Christmas tree against a wall or in a corner in a confined living quarters.

Still yet another object of the present invention is to provide a new corner/wall situated Christmas tree stand that is easy and convenient to set up and use.

Even still another object of the present invention is to provide a new corner/wall situated Christmas tree stand that takes much less space than that of a convention Christmas tree stand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
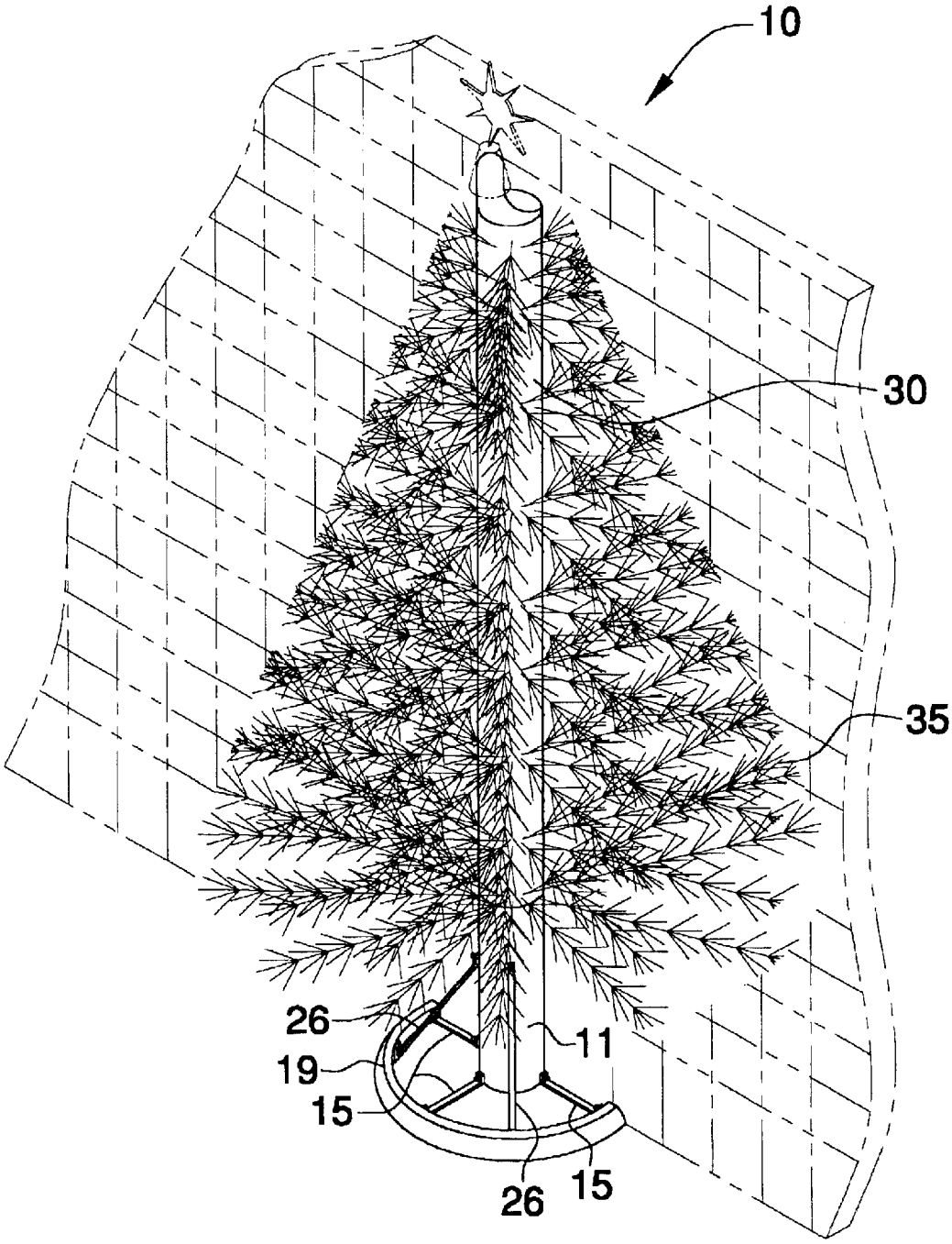
FIG. 1 is a perspective view of a new corner/wall situated Christmas tree stand according to the present invention.
Figure 2:
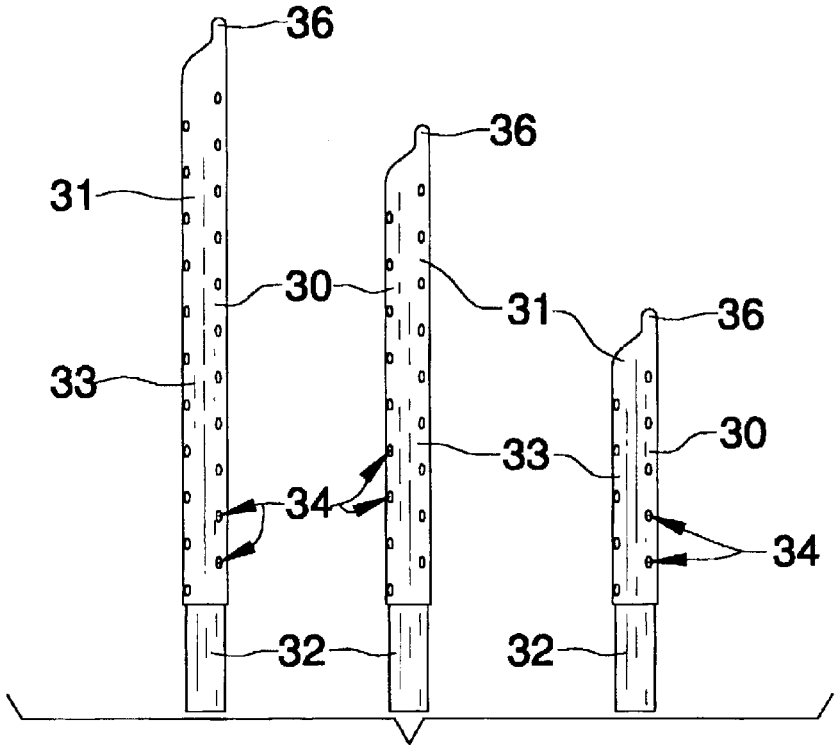
FIG. 2 are side elevational views the various embodiments of the elongate tubular tree support member of the present invention.
Figure 3:
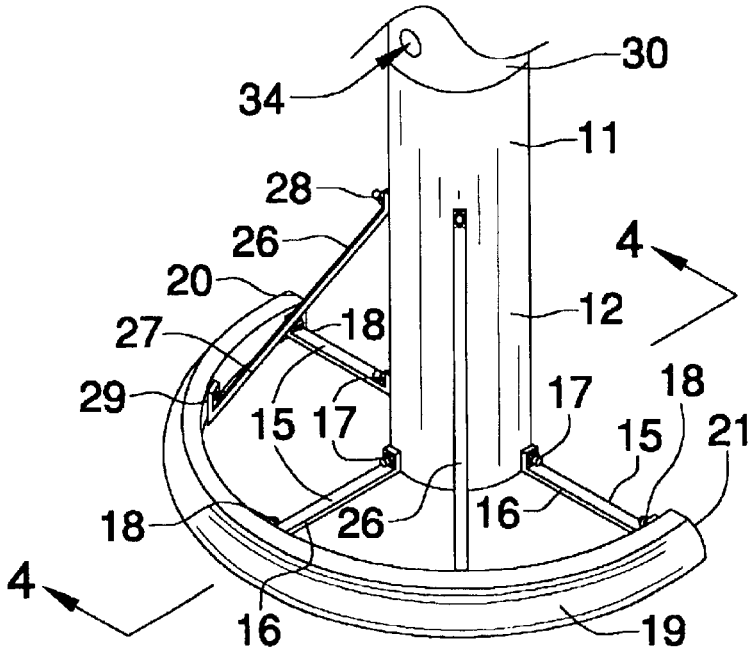
FIG. 3 is a perspective view of the base assembly of the present invention.
Figure 4:
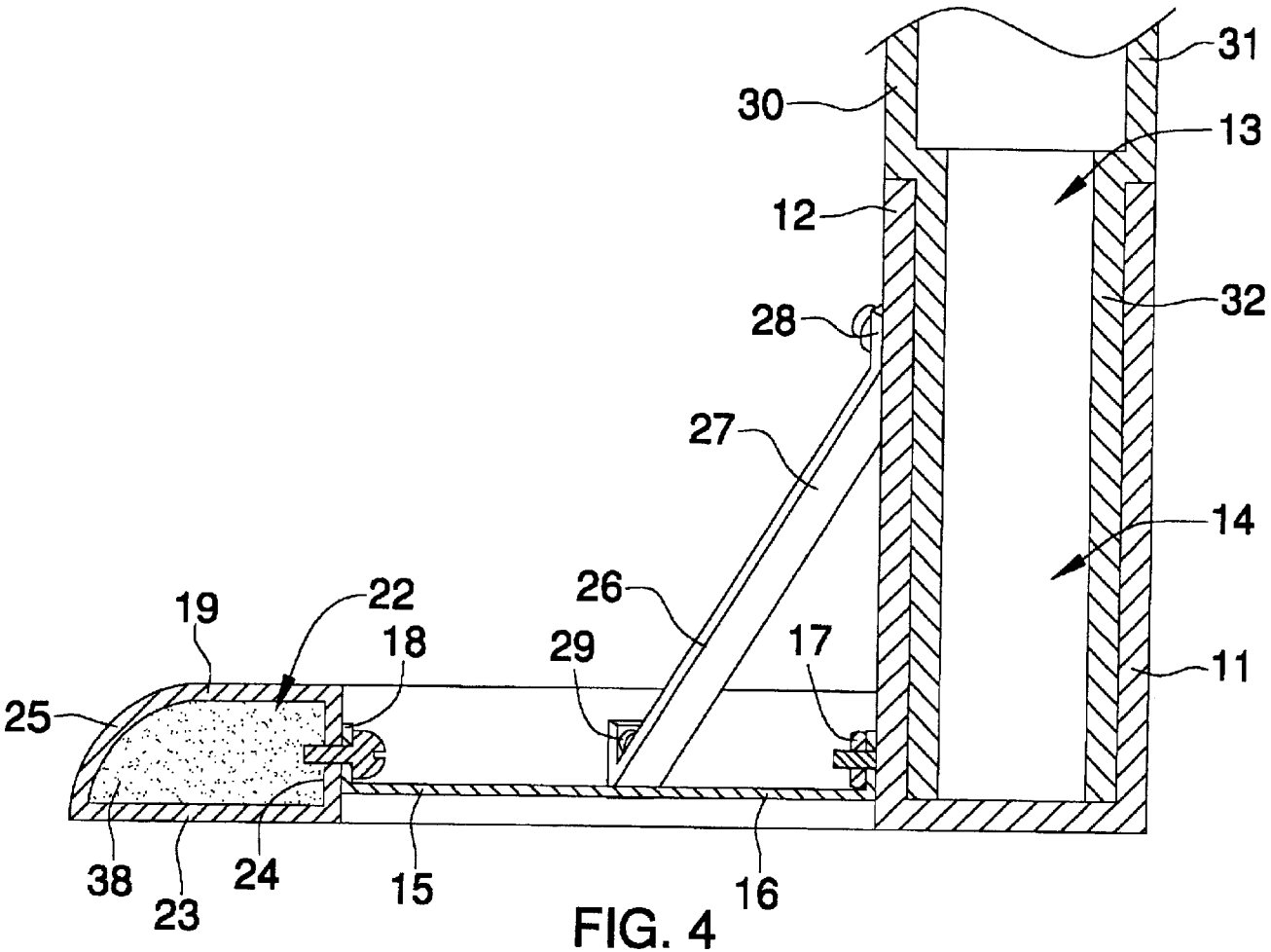
FIG. 4 is a cross-sectional view of the base assembly of the present invention.
Figure 5:
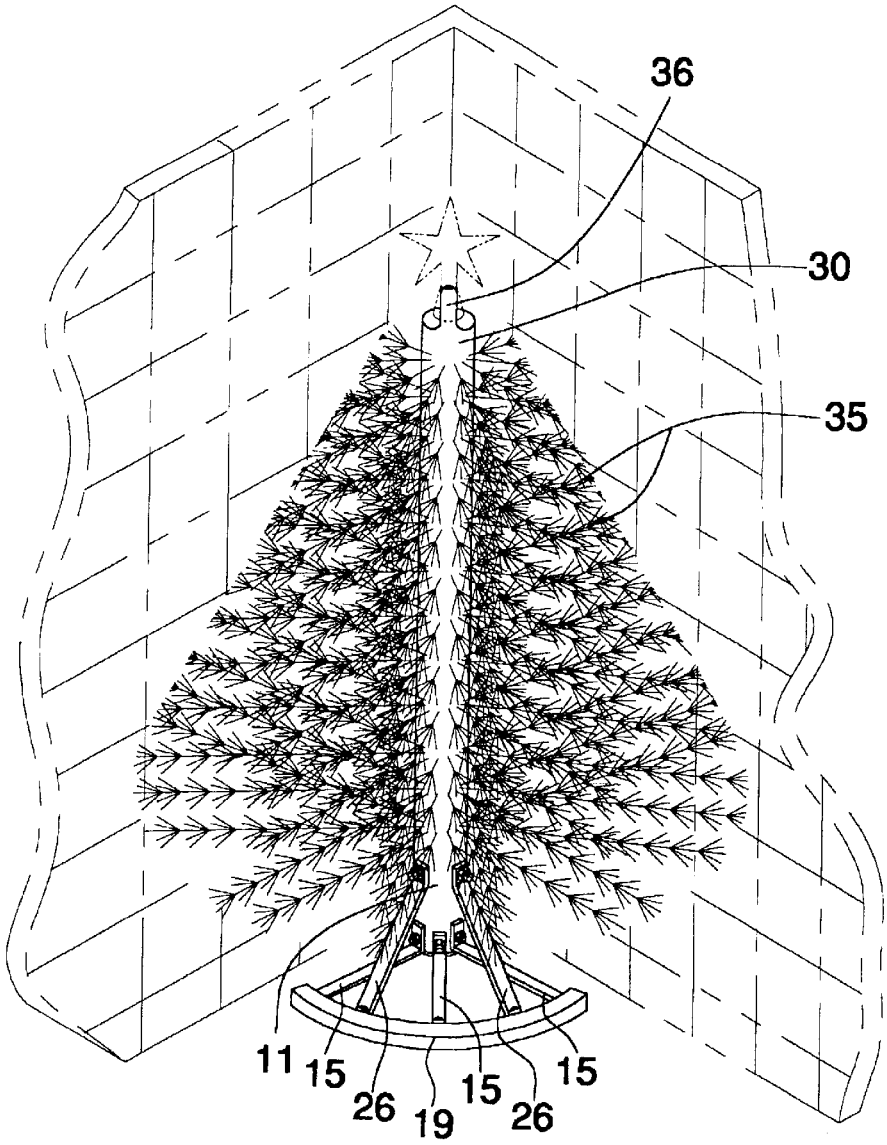
FIG. 5 is another perspective view of the present invention.

With reference now to the drawings, and in particular to FIGS. 1 through 5 thereof, a new corner/wall situated Christmas tree stand embodying the principles and concepts of the present invention and generally designated by the reference numeral 10 will be described.

As best illustrated in FIGS. 1 through 5, the corner/wall situated Christmas tree stand 10 generally comprises a base assembly including a tubular support base 11 having a wall 12, an open top 13, and a bore 14 being disposed therein through the open top 13, for resting in a corner or against a wall structure. The base assembly also includes a plurality of support arms 15 being fastened with fasteners 37 to the wall 12 of the tubular support base 11 and extending radially therefrom, and further includes a semi-annular tubular ring 19 being no more than 180 degrees and being spaced about the tubular support base 11 and being fastened with fasteners 37 to the support arms, and also includes a plurality of braces 26 being fastened with fasteners 37 to the tubular support base 11 and to the semi-annular tubular ring 19. Each of the support arms 15 includes an elongate main portion 16 and also includes end portions 17,18 which are angled relative to the elongate main portion 16 and which are fastened to the tubular support base 11 and to the semi-annular tubular ring 19. The semi-annular tubular ring 19 has closed ends 20,21 which are adapted to rest against a wall structure, and also has a cavity 22 being disposed therein. The base assembly further includes sand 38 being disposed in the cavity 22 of the semi-annular tubular ring 19 to weight down the semi-annular tubular ring 19 upon a ground with the semi-annular tubular ring 19 having flat bottom and inner side walls 23,24 and also having a curved outer side wall 25. Each of the braces 26 includes an elongate main portion 27 and also includes end portions 28,29 which are angled relative to the elongate main portion 27 and which are fastened to near the open top 13 of the tubular support base 11 and to the semi-annular tubular ring 19.

An elongate tubular tree support member 30 is removably supported upon the tubular support base 11 and is adapted to support branches 35 of an artificial Christmas tree for resting in a corner or against a wall structure. The elongate tubular tree support member 30 has an elongate main portion 31 and an annular recessed bottom portion 32 which is securely and removably disposed in the bore 14 through the open top 13 of the tubular support base 11, and also has a finger portion 36 integrally extending upwardly from a top end of the elongate tubular tree support member for supporting a Christmas ornament. The elongate tubular tree support member 30 has holes 34 being spaced about a semi-circumferential portion 33 of and extending along a length of the elongate main portion 31 thereof with the semi-circumferential portion 33 facing away from a corner or wall structure.

In use, the user places the base assembly and the elongate tubular support member 30 either in a corner or up against a wall structure with the semi-circumferential portion 33 facing away from the corner or the wall structure, and inserts the branches 35 of the artificial Christmas tree in the holes 34 of the elongate tubular support member 30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the corner/wall situated Christmas tree stand. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A corner/wall situated Christmas tree stand comprising:

a base assembly including a tubular support base having a wall, an open top, and a bore being disposed therein through said open top, for resting in a corner or against a wall structure, said base assembly also including a plurality of support arms being fastened with fasteners to said wall of said tubular support base and extending radially therefrom, and further including a semi-annular tubular ring being no more than 180 degrees and being spaced about said tubular support base and being fastened with fasteners to said support arms, and also including a plurality of braces being fastened with fasteners to said tubular support base and to said semi-annular tubular ring; and an elongate tubular tree support member being removably supported upon said tubular support base and being adapted to support branches of an artificial Christmas tree for resting in a corner or against a wall structure.

2. The corner/wall situated Christmas tree stand as described in claim 1, wherein each of said support arms includes an elongate main portion and also includes end portions which are angled relative to said elongate main portion and which are fastened to said tubular support base and to said semi-annular tubular ring.

3. The corner/wall situated Christmas tree stand as described in claim 2, wherein said semi-annular tubular ring has closed ends which are adapted to rest against a wall structure, and also has a cavity being disposed therein, said base assembly further including sand being disposed in said cavity of said semi-annular tubular ring to weight down said semi-annular tubular ring upon a ground, said semi-annular tubular ring having flat bottom and inner side walls and also having a curved outer side wall.

4. The corner/wall situated Christmas tree stand as described in claim 3, wherein each of said braces includes an elongate main portion and also includes end portions which are angled relative to said elongate main portion and which are fastened to near said open top of said tubular support base and to said semi-annular tubular ring.

5. The corner/wall situated Christmas tree stand as described in claim 4, wherein said elongate tubular tree support member has an elongate main portion and an annular recessed bottom portion which is securely and removably disposed in said bore through said open top of said tubular support base, and also has a finger portion extending upwardly from a top end of said elongate tubular tree support member for supporting a Christmas ornament.

6. The corner/wall situated Christmas tree stand as described in claim 5, wherein said elongate tubular tree support member has holes being spaced about a semi-circumferential portion of and extending along a length of said elongate main portion thereof, said semi-circumferential portion facing away from a corner or wall structure.

* * * * *